US009027518B2

(12) United States Patent
Kim et al.

(10) Patent No.: US 9,027,518 B2
(45) Date of Patent: May 12, 2015

(54) CONTINUOUSLY VARIABLE VALVE LIFT DEVICE

(75) Inventors: Dojoong Kim, Ulsan Metropolitan-si (KR); Minoru Shiino, Hadano (JP); Ken-ya Sugawara, Hadano (JP); Mamoru Kato, Hadano (JP)

(73) Assignees: University of Ulsan Foundation for Industry Cooperation, Ulsan Mteropolitan-si (KR); Nittan Valve Co., Ltd., Hadano-shi (JP)

( * ) Notice: Subject to any disclaimer, the term of this patent is extended or adjusted under 35 U.S.C. 154(b) by 0 days.

(21) Appl. No.: 14/352,743

(22) PCT Filed: Oct. 19, 2011

(86) PCT No.: PCT/JP2011/074041

§ 371 (c)(1),
(2), (4) Date: Apr. 18, 2014

(87) PCT Pub. No.: WO2013/057804

PCT Pub. Date: Apr. 25, 2013

(65) Prior Publication Data

US 2014/0299082 A1 Oct. 9, 2014

(51) Int. Cl.
*F01L 1/34* (2006.01)
*F01L 13/00* (2006.01)

(52) U.S. Cl.
CPC ..... *F01L 1/34* (2013.01); *F01L 13/0015* (2013.01); *F01L 13/0026* (2013.01); *F01L 13/0063* (2013.01); *F01L 2105/00* (2013.01)

(58) Field of Classification Search
USPC ..... 123/90.16, 90.39
See application file for complete search history.

(56) References Cited

U.S. PATENT DOCUMENTS

| | | | | |
|---|---|---|---|---|
| 7,246,578 | B2 * | 7/2007 | Nakamura et al. | 123/90.16 |
| 2006/0288972 | A1 | 12/2006 | Hara et al. | |
| 2009/0288623 | A1 | 11/2009 | Lee et al. | |

FOREIGN PATENT DOCUMENTS

| | | | |
|---|---|---|---|
| JP | 2007-40291 | A | 2/2007 |
| JP | 2007-170333 | A | 7/2007 |
| JP | 2009-236105 | A | 10/2009 |
| JP | 2009-281386 | A | 12/2009 |
| JP | 2010-019179 | A | 1/2010 |

OTHER PUBLICATIONS

International Search Report for PCT/JP2011/074041, Mailing Date of Dec. 6, 2011.

* cited by examiner

*Primary Examiner* — Zelalem Eshete
(74) *Attorney, Agent, or Firm* — Westerman, Hattori, Daniels & Adrian, LLP

(57) ABSTRACT

A continuously variable valve lift device with improved lift amount change accuracy includes a rocker arm causing an engine valve to perform an opening/closing operation with a cam of a cam shaft, and an engine valve lift amount change mechanism. The mechanism has a control shaft which has an eccentric circular disc cam, a control arm which swings about the eccentric circular disc cam and having a cam contact portion in contact with a first cam and a first arm, second biasing means for biasing the cam contact portion against the first cam, a second cam portion of a free-form surface shape contacting with the second arm and the rocker arm, a cam member supported so as to be capable of turning around the shall main body, and a link arm with both ends supported so as to be capable of turning by the first arm and the second arm.

2 Claims, 3 Drawing Sheets

CONTINUOUSLY VARIABLE VALVE LIFT DEVICE

TECHNICAL FIELD

The present invention relates to a technique related to a continuously variable valve lift device having a lift amount change mechanism with improved accuracy of lift amount change in an engine valve.

BACKGROUND ART

As a variable valve lift device having an engine valve lift amount change mechanism, there is a device shown in the following Patent Document 1. The variable valve lift device shown in the following Patent Document 1 is composed of, as shown in FIGS. 1 to 4 of the following Patent Document 1, an input shaft (cam shaft) 100, a valve opening/closing unit (rocker arm mechanism) 200 which has a rocker arm receiving pressing force by an input cam 110 and bias force in a valve closing direction by a biasing means (not shown), and a connecting portion (a lift amount change mechanism) which changes a lift amount of an engine valve.

A lift arm 440 receives pressing force from the rotating input cam. 110 via a connecting link 430 coupled by a roller 413, a second member 412, and a first connecting pin 450. As a result, the lift arm 440 rotates around an eccentric shaft 300, that rotates a needle bearing 220 of the rocker arm in contact with a lift arm contact portion 441 having a free-form surface shape. As a result, due to the needle bearing 220 rotating while being in contact with a predetermined range of the lift arm contact portion 441, the valve opening/closing unit 200 causes the engine valve to perform an opening/closing operation in a lift amount based on the free-form surface shape of the contact range of the lift arm contact portion 441.

On the other hand, in the case where a lift amount of the valve is changed, the eccentric shaft 300 is rotated, to move the first connecting pin 450 coupled to a control shaft 420. At that time, a position in contact with the input cam 110 is changed on the roller 413, and a contact range between the lift arm contact portion 441 and the needle bearing 220 of the rocker arm is changed on the lift arm 440. As a result, in the valve opening/closing unit 200, a shape of the free-form surface of the lift arm contact portion 441 is changed in the range in contact with the needle bearing 220, and therefore, a lift amount of the engine valve is changed.

PRIOR ART DOCUMENT

Patent Document

Patent Document 1: Japanese Published Unexamined Patent Application No. 2009-236105

SUMMARY OF THE INVENTION

Problem(s) to be Solved by the Invention

In a continuously variable, valve lift device of Patent Document 1, as shown in FIG. 2 of Patent Document 1, a first member 411 of an input link 410 and the control shaft 420 are supported so as to be capable of turning by the eccentric shaft 300, the second member 412 and the control shaft 420 are supported so as to be capable of turning by the first connecting pin 450, and the first member 411 and the second member 412 are supported so as to be capable of turning by a support shaft of the roller 413. In other words, the input link 410 and the control shaft 420 are coupled to each other via the three connecting shafts.

However, these three connecting shafts cause backlash due to manufacturing errors between the input link 410 and the control shaft 420. The backlash which occurs in the lift amount change mechanism is undesirable in terms of reducing the accuracy at the time of changing a lift amount of the engine valve.

The present invention relates to a technique related to a continuously variable valve lift device having a lift amount change mechanism with improved accuracy of changing a lift amount of an engine valve by reducing internally occurring backlash in consideration of the above-described problem.

Means for Solving the Problem

A continuously variable valve lift device according to a first aspect of the invention includes a cam shaft, a rocker arm which causes an engine valve to perform an opening/closing operation by pressing force of a first cam of the rotating cam shaft and bias force in a valve-closing direction by first biasing means, and a lift amount change mechanism which is provided between the first cam and the rocker arm, the lift amount change mechanism changes a lift amount of the engine valve, the continuously variable valve lift device wherein the lift amount change mechanism has a control shaft which has a shaft main body, and an eccentric circular disc cam integrated with the shaft main body, and which is configured so as to be capable of turning, a control arm a cam contact portion in contact with the first cam of the cam shaft at one end, and has a first arm at the other end, and whose central portion is supported so as to be capable of swinging around the eccentric circular disc cam, second biasing means for biasing the cam contact portion against the first cam, a cam member which has a second arm at one end, and has a second cam portion of a free-form surface shape in contact with the rocker arm at the other end, and whose central portion is supported so as to be capable of swinging around the shaft main body, the cam member moves the engine valve up and down based on the free-form surface shape of the second cam portion, and a link arm whose both ends are respectively supported so as to be capable of swinging by the first arm and the second arm.

In the continuously variable valve lift device according to the first aspect of the present application, when the first cam in contact with the cam contact portion rotates, the control arm and the cam member which are coupled to one another with the link arm swing around the central axis of the control shaft, to cause the engine valve of the rocker arm to perform an opening/closing operation according to the free-form surface shape of the second cam portion.

(Operation) On the other hand, in the case where a lift amount of the engine valve is changed, the control shaft is turned, to change a distance from the center of rotation of the control shaft main body to the cam center of the first cam. At that time, a position in contact with the first cam is changed on the roller, and a contact range between the second cam portion having the free-form surface shape and the rocker arm is changed on the cam member. As a result, on the rocker arm, the shape of the free-form surface of the second cam portion is changed in the contact range with the second cam, and therefore, a lift amount of the engine valve is changed.

In the continuously variable valve lift device according to the first aspect of the present application, because the member corresponding to the input link in Patent Document 1 is formed integrally with the control shaft, no connecting shaft is formed therebetween. The lift amount change mechanism of the first aspect of the present applications composed of a simple four-joint link formed of four members of the eccentric circular disc cam of the control shaft, the control arm, the link arm, and the cam member. As a result, in the first aspect of the present application, backlash in the lift amount change mechanism is considerably reduced due to an improvement in rigidity of the lift amount change mechanism.

Further, a second aspect of the invention is the continuously variable valve lift device according to the first aspect of the invention, in which the link arm is formed so as to be length-adjustable, thereby configuring an engine valve lift amount correction mechanism.

(Operation) In the continuously variable valve lift device according to the second aspect of the invention, the engine valve lift amount correction mechanism is easily and simply formed only by the length-adjustable mechanism of the link arm. In the continuously variable valve lift device according to the second aspect of the invention, because a shift of the contact range between the second cam portion and the rocker arm is corrected by adjusting the length of the link arm by the lift amount correction mechanism, the engine valve performs an opening/closing operation in a correct lift amount.

Effect of the Invention

In accordance with the continuously variable valve lift device according to the first aspect of the invention, because backlash which occurs in the lift amount change mechanism is considerably reduced, the accuracy of changing a lift amount of the engine valve is considerably improved. Further, in accordance with the continuously variable, valve lift device according to the first aspect of the invention, because a member corresponding to the input link in Patent Document 1 is omitted, it is possible to realize low-cost production due to a reduction in number of components and man-hours.

Further, in accordance with the continuously variable valve lift device according to the second aspect of the invention, the engine valve lift amount correction mechanism is easily configured at low cost, and fine adjustment for a lift amount of the engine valve is easy.

BEST MODE FOR CARRYING OUT THE INVENTION

Figure 1:
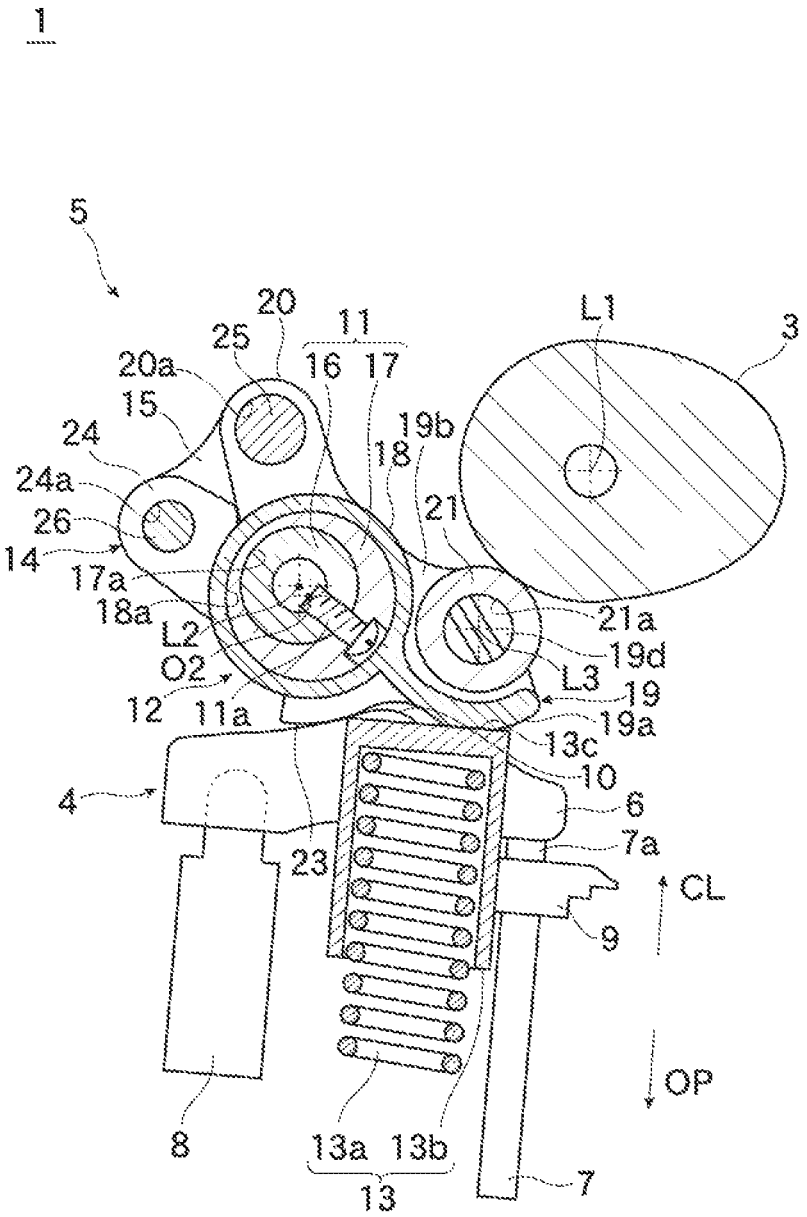
FIG. 1 is a cross sectional view showing a state in which an embodiment of a continuously variable valve lift device is cut along a longitudinal direction of a control arm.
Figure 2:
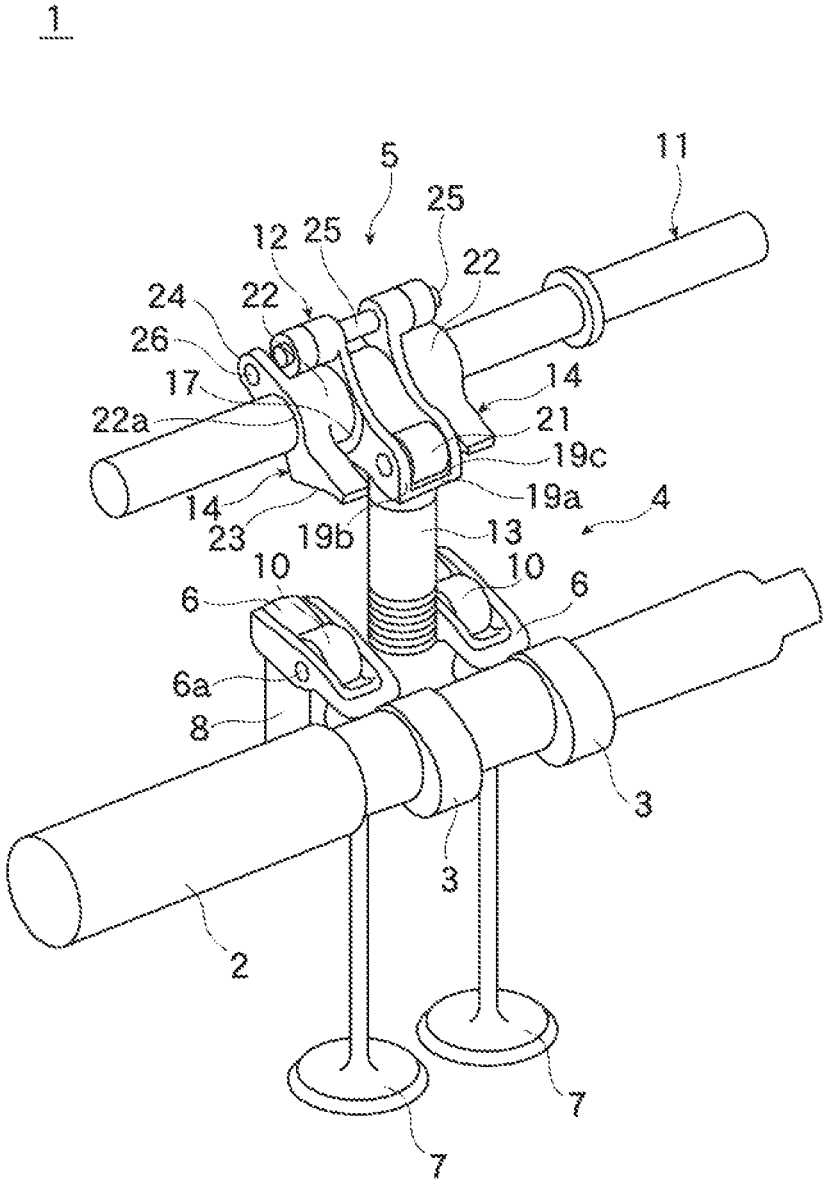
FIG. 2 is a partial exploded perspective view in which a part of the continuously variable valve lift device is divided.

An embodiment of a continuously variable valve lift device will be described with reference to FIGS. 1 to 3. A continuously variable valve lift device 1 of the present embodiment includes a cam shaft 2 which rotates, together with a first cam 3 integrally provided therewith, around an axis line L1 showing the center of turning, a pair of rocker arm mechanisms 4 having engine valves, and a lift amount change mechanism 5 which changes a lift amount of the engine valve.

Each of the rocker arm mechanisms 4 is composed of a rocker arm 6, an engine valve 7, a supporting member 8, and a valve spring (first biasing means) 9. An axial member 6*a* is provided in the central portion of the rocker arm 6, and a roller 10 is provided on the axial member 6*a* so as to be capable of turning. Further, the base end portion of the rocker arm 6 is held so as to be capable of swinging around a fulcrum (not shown) of the supporting member by the supporting member 8, and a valve stem 7*a* of the engine valve 7 is fixed to the distal end portion of the rocker arm 6. The distal end portion of the rocker arm 6 receives bias force in a valve-closing direction of the engine valve 7 (in a direction of a symbol CL showing the upper side in FIG. 1. A symbol OP denotes a valve-opening direction) by the valve spring 9.

Further, the lift amount change mechanism 5 has a control shaft 11, a control arm 12, second biasing means 13, a pair of cam members (14, 14), and a pair of link arms (15, 15). The control shaft 11 is composed of a shaft main body 16 and an eccentric circular disc cam 17 having an eccentric circular hole 17*a*, and turns by operation means (not shown) such as a motor or a hydraulic mechanism. The eccentric circular disc cam 17 is integrated with the shaft main body 16 by fixing the shaft main body 16 to the eccentric circular hole 17*a* with a connecting member 11*a*, and a cam center O2 of the eccentric circular disc cam 17 is provided at a position eccentric from an axis line L2 showing the center of turning of the shaft main body 16. The eccentric circular disc cam 17 eccentrically turns around the axis line L1 by the operation means (not shown).

The control arm 12 is composed of a main body portion (the central portion in the first aspect) 13, a roller supporting portion 19, a roller 21 (the cam contact portion in the first aspect), and a pair of first arms (20, 20). The main body portion 18 has a cylindrical shape, and the roller supporting portion 19 and the first arms (20, 20) are formed so as to respectively project from the outer circumferential surface of the main body portion 18. The eccentric circular disc cam 17 integrated with the shaft main body 15 is internally in contact with an inner circumferential surface 18*a* of the main body portion 18 having the cylindrical shape, and the control arm 12 is held so as to be capable of turning around the cam center O2 by the eccentric circular disc cam 17 of the control shaft 11.

The roller supporting portion 19 is composed of a bottom portion 19*a* formed as a downward convex curved surface, a pair of vertical wall portions (19*b*, 19*c*) and an axial member 19*d* fixed to the vertical wall portions. The axial member 19*d* is disposed such that an axis line L3 showing the center is parallel to the axis lines L1 and L2, and is inserted into a circular hole 21*a* of the roller 21, thereby holding the roller 21 so as to be capable of turning. A pair of coaxial circular holes (20*a*, 20*a*) are provided in the first arms (20, 20), and an axial member 25 is fixed into the circular holes (20*a*, 20*a*) so as to project to the right and left of the first arm (20, 20).

The second biasing means 13 is composed of a compression spring 13*a* and a cap 13*b*. The cap 13*b* having a top surface of a cap 13*c* covering the compression spring 13*a* from above, and the top surface of the cap 13*c* applies bias force toward the first cam 3, to the bottom portion 19*a* of the roller supporting portion 19 by the compression spring 13*a*, and the roller 21 is held so as to be always in contact with the outer circumferential surface of the first cam 3 by the second biasing means 13.

In addition, as a cam contact portion of the control arm 12, instead of adopting the roller 21 rotating together with the first cam 3, a cam slide-contact portion with which the first cam 3 is in slide-contact may be adopted. The cam slide-contact portion may be formed into any shape such as a shape having a planar surface as long as it is a shape capable of rotating while the first cam 3 is in slide-contact therewith. However, it is more preferable that the cam slide-contact portion has a columnar shape, a shape having a circular arc surface, or a shape having other various curved surfaces, thereby allowing the slide-contacting first cam 3 to smoothly rotate.

The pair of cam members (14, 14) are composed of main body portions (22, 22), second cam portions (23, 23), and second arms (24, 24). A circular hole 22*a* is provided in the main body portion (the central portion in the first aspect) 22. The second cam portion 23 and the second arm 24 are formed so as to respectively project in a radiation direction from the outer circumferential surface of the main body portion 22. The cam members (14, 14) are held so as to be capable of turning around the axis line 12 showing the center of the shaft main body 16 at the right and left of the control shaft 11 by inserting the shaft main body 16 projecting to the right and left from the eccentric circular disc cam 17, into the circular holes (22*a*, 22*a*). Circular holes (24*a*, 24*a*) are provided in the second arms (24, 24).

Figure 3:
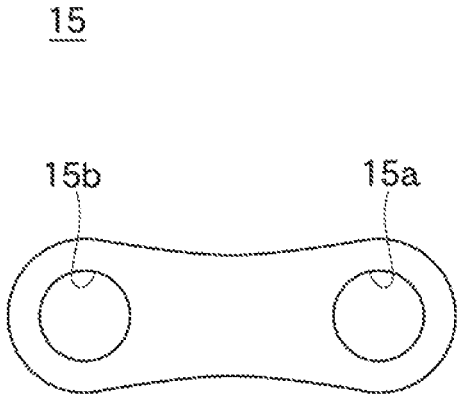
FIG. 3 is a diagram showing a link arm of a lift amount correction mechanism.

Further, the first arms (20, 20) and the second arms (24, 24) are coupled to one another respectively with the link arms (15, 15) as shown in FIG. 3. One ends of the link arms (15, 15) are held so as to be capable of turning by the axial member 25 by inserting the axial member 25 projecting to the right and left from the first arms (20, 20), into first circular holes (15*a*, 15*a*) of the link arms (15, 15). Further, the other ends of the link arms (15, 15) are held by a pair of axial members 26, 26) so as to be capable of respectively turning by respectively inserting the axial members (26, 26) into second circular holes (15*b*, 15*b*) of the link arms (15, 15) and the circular holes (24*a*, 24*a*) of the second arms (24, 24).

The roller 10 of the rocker arm 6 is always pressed against the second cam portion 23 having the free-form surface shape by the valve spring 9. The free-form surface shape of the second cam portion 23 is formed so as to change a distance from the axis line L2 showing the center of the control shaft to a contact position between the roller 10 and the second cam portion 23 according to the contact position, and the lift amount change mechanism 5 is configured to change a lift amount of the engine valve 7 by changing a swing range of the second cam portion 23 with respect to the roller 10. In addition, with respect to the rocker arm 6, the roller 10 may be omitted, and a slide-contact portion with which the second cam portion 23 is in slide-contact may be provided, so as to be in slide-contact with the second cam portion 23.

Next, the operation of the continuously variable valve lift device 1 will be described. When the first cam 3 of the cam shaft rotates, the control arm 12, the link arms (15, 15), and the cam members (14, 14) swing centering on the axis line L2. At that time, the second cam portions (23, 23) swing back and forth around the axis line L2, to turn the roller 10 along the free-form surface of the second cam portion 23. Due to the roller 10 turning along the second cam portion 23, the rocker arm 6 opens and closes the engine valve 7 based on the free-form surface shape of the second cam portion 23.

On the other hand, in the case where a lift amount of the engine valve 7 is changed, the control shaft 11 is turned, to change a distance from the axis line L2 showing the center of rotation of the shaft main body 16 to the axis line L1 showing the center of rotation of the first cam 3. As a result, a position in contact with the first cam 3 is changed on the roller 21 of the control arm 12, and a contact range between the second cam portion 23 having the free-form surface shape and the roller 10 of the rocker arm 6 is changed on the cam member 14, so as to change the free-form surface shape in the contact range, and therefore, a lift amount of the engine valve 7 is changed.

Figure 4:
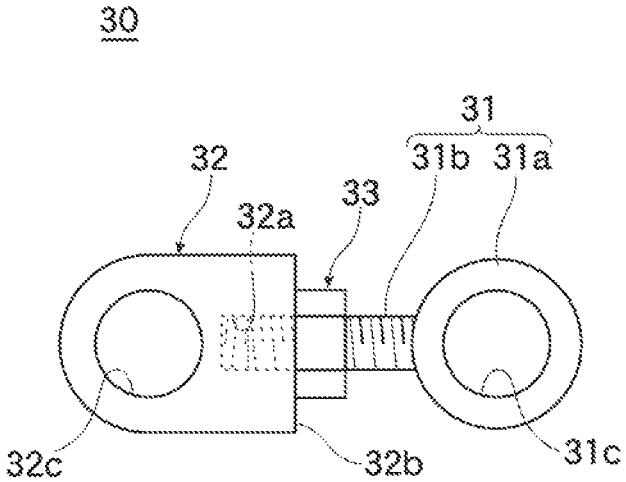
FIG. 4 is a diagram showing a modification of the link arm.

Next, a modification of the link arm for providing the lift amount correction mechanism to the lift amount change mechanism will be described with reference to FIG. 4. The link arm 30 of FIG. 4 is to be attached to the first are 20 and the second arm 24 in place of the link arm 15 in the first embodiment of FIG. 1. The link arm 30 is formed of a male screw member 31, a female screw member 32, and a nut 33. The male screw member 31 is formed such that a ring portion 31*a* on the right end side and a male screw portion 31*b* on the left end side are integrated. A female screw hole 32*a* opening into a right end surface 32*b* is provided in the female screw member 32. A circular hole 31*c* with which the axial member 25 in FIG. 1 is brought into internal contact is provided in the inner circumference of the ring portion 31*a*, and a circular hole 32*c* with which the axial member 26 in FIG. 1 is brought into internal contact is provided on the left side of the female screw hole 32*a* in the female screw member 32.

The nut 33 is screwed on the male screw member 31. The male screw member 31 is integrated with the female screw member 32 by screwing the male screw portion 31*b* into the female screw hole 32*a*, and is fixed to the female screw member 32 so as not to be movable by tightening the nut 33 on the right end surface 32*b*. A pair of the link arms 30 are provided at the right and left of the link arm 15. One ends of the pair of link arms (30, 30) are held by the axial members (25, 25) so as to be capable of respectively turning by respectively inserting the axial members (25, 25) into the circular holes (31*c*, 31*c*) of the ring portions 31 and the circular holes (20*a*, 20*a*) of the first arms (20, 20). On the other hand, the other ends of the link arms (30, 30) are respectively held so as to be capable of respectively turning by the axial members (26, 26) by respectively inserting the axial members (26, 26) into the circular holes (32*c*, 32*c*) of the female screw members 32 and the circular holes (24*a*, 24*a*) of the second arms (24, 24).

The length of the link arm 30 is extended and contracted by turning the male screw member 31 with respect to the female screw member 32. On the other hand, in the case where fluctuation in a lift amount of the engine valve 7 which occurs per manufacturing lot is corrected, the link arm 30 is extended and contracted, thereby making fine adjustment of a contact position between the second cam portion 23 and the roller 10 of the rocker arm 6. As a result, in the continuously variable valve lift device having the link arm 30 in place of the link arm 15, fluctuation in a lift amount of the engine valve 7 is properly corrected. In addition, in the link arms composing the lift amount correction mechanism, configuration other than the configuration composed of screws may be adopted as long as it is a configuration which can be extended/contracted.

DESCRIPTION OF SYMBOLS

1: Continuously variable valve lift device
2: Cam shaft
3: First cam
5: Lift amount change mechanism
6: Rocker arm
7: Engine valve
9: First biasing means (valve spring)
11: Control shaft
12: Control arm
13: Second biasing means
14: Cam member
15: Link arm
16: Shaft main body
17: Eccentric circular disc cam
18: Central portion
20: First arm
21: Roller (cam contact portion)

22: Central portion
23: Second cam portion
24: Second arm
30: Link arm (lift amount correction mechanism)
CL: Valve-closing direction

The invention claimed is:

1. A continuously variable valve lift device comprising:

a cam shaft;

a rocker arm which causes an engine valve to perform an opening/closing operation by pressing force of a first cam of the rotating cam shaft and bias force in a valve-closing direction by first biasing means; and a lift amount change mechanism which is provided between the first cam and the rocker arm, the lift amount change mechanism changes a lift amount of the engine valve, the continuously variable valve lift device wherein the lift amount change mechanism has a control shaft which has a shaft main body, and an eccentric circular disc cam integrated with the shaft main body, and which is configured so as to be capable of turning, a control arm which has a cam contact portion in contact with the first cam of the cam shaft at one end, and has a first arm at the other end, and whose central portion is supported so as to be capable of swinging around the eccentric circular disc cam, second biasing means for biasing the cam contact portion against the first cam, a cam member which has a second arm at one end, and has a second cam portion of a free-form surface shape in contact with the rocker arm at the other end, and whose central portion is supported so as to be capable of swinging around the shaft main body, the cam member moves the engine valve up and down based on the free-form surface shape of the second cam portion, and a link arm whose both ends: are respectively supported so as to be capable of swinging by the first arm and the second arm.

2. The continuously variable valve, lift device according to claim 1, wherein the link arm is formed so as to be length-adjustable, thereby configuring an engine valve lift amount correction mechanism.

* * * * *